US008286815B2

(12) United States Patent
Thierjung et al.

(10) Patent No.: US 8,286,815 B2
(45) Date of Patent: Oct. 16, 2012

(54) PLASTIC CAN PACKAGE

(75) Inventors: George A. Thierjung, Broomfield, CO (US); James C. Gratke, Thornton, CO (US)

(73) Assignee: Amcor Rigid Plastic USA, Inc., Ann Arbor, MI (US)

( * ) Notice: Subject to any disclaimer, the term of this patent is extended or adjusted under 35 U.S.C. 154(b) by 359 days.

(21) Appl. No.: 12/573,338

(22) Filed: Oct. 5, 2009

(65) Prior Publication Data

US 2011/0079576 A1 Apr. 7, 2011

(51) Int. Cl.
*B65D 23/10* (2006.01)
*B65D 25/28* (2006.01)

(52) U.S. Cl. ..... 215/384; 215/398; 220/771

(58) Field of Classification Search ..... 220/771, 220/258.672; 215/384, 398
See application file for complete search history.

(56) References Cited

U.S. PATENT DOCUMENTS

| | | | | | |
|---|---|---|---|---|---|
| 3,938,686 | A | * | 2/1976 | Milligan et al. | 215/232 |
| 4,117,950 | A | | 10/1978 | Allen | 220/306 |
| 4,235,349 | A | | 11/1980 | Uhlig | 220/281 |
| D262,856 | S | | 2/1982 | MacTavish et al. | D7/77 |
| 4,697,719 | A | * | 10/1987 | Allen | 220/258.2 |
| 4,702,389 | A | | 10/1987 | Bozinovich et al. | 220/306 |
| D294,325 | S | | 2/1988 | Fiore, Jr. | D7/320 |
| 4,886,184 | A | | 12/1989 | Chamourian | 220/306 |
| 5,199,587 | A | | 4/1993 | Ota et al. | 215/1 C |
| 5,226,550 | A | * | 7/1993 | Mikolaitis et al. | 215/384 |
| D370,153 | S | | 5/1996 | Chaney et al. | D7/511 |
| 6,029,837 | A | * | 2/2000 | Slat et al. | 215/384 |
| D423,936 | S | | 5/2000 | Smith et al. | D9/520 |
| D424,446 | S | | 5/2000 | Silvers et al. | D9/520 |
| 6,277,321 | B1 | | 8/2001 | Vailliencourt et al. | 264/529 |
| D448,675 | S | | 10/2001 | Thierjung | D9/541 |
| 6,349,839 | B1 | | 2/2002 | Mooney | 215/384 |
| 6,390,316 | B1 | | 5/2002 | Mooney | 215/384 |
| D462,012 | S | | 8/2002 | Manderfield, Jr. | D9/530 |
| 6,439,413 | B1 | | 8/2002 | Prevot et al. | 215/381 |
| 6,467,639 | B2 | | 10/2002 | Mooney | 215/384 |
| D465,418 | S | | 11/2002 | Thierjung | D9/560 |
| D473,142 | S | | 4/2003 | Beaver | D9/530 |
| D480,312 | S | | 10/2003 | Mungur et al. | D9/537 |
| D480,974 | S | | 10/2003 | Blank | D9/543 |
| D482,974 | S | | 12/2003 | Nottingham et al. | D9/531 |
| D483,269 | S | | 12/2003 | Walsh et al. | D9/522 |
| 6,763,968 | B1 | | 7/2004 | Boyd et al. | 220/608 |

(Continued)

FOREIGN PATENT DOCUMENTS

JP 02-085142 3/1990

(Continued)

*Primary Examiner* — Sue Weaver
(74) *Attorney, Agent, or Firm* — Brinks Hofer Gilson & Lione

(57) ABSTRACT

A package includes a container having a closed bottom, an open top having an outwardly extending flange, and a body having an enclosed generally cylindrical perimeter surrounding a longitudinal axis between the bottom and the top. The body can include an opposed pair of longitudinally extending inward protrusions forming a graspable handle dividing the body into a front label surface occupying at least 180° of the body and a back label surface smaller than the front label surface. Each inward protrusion can include a plurality of longitudinal ridges on a forwardly facing surface to facilitate single handed grasping of the package. A plurality of circumferential ribs can be situated between an upper end of the inward protrusions and the outwardly extending flange to preserve the package shape during storage on commercial food storage racks.

2 Claims, 6 Drawing Sheets

U.S. PATENT DOCUMENTS

| | | | | |
|---|---|---|---|---|
| D497,311 | S | 10/2004 | Walsh et al. | D9/522 |
| D500,679 | S | 1/2005 | Walsh et al. | D9/522 |
| D501,795 | S | 2/2005 | Walsh et al. | D9/522 |
| D507,184 | S | 7/2005 | Beaver et al. | D9/530 |
| D511,101 | S | 11/2005 | Nottingham et al. | D9/531 |
| 7,097,060 | B2 * | 8/2006 | Penny et al. | 215/384 |
| D528,919 | S | 9/2006 | Kipperman et al. | D9/529 |
| 7,169,418 | B2 | 1/2007 | Dalton et al. | 426/110 |
| 7,169,419 | B2 | 1/2007 | Dalton et al. | 426/110 |
| D541,662 | S | 5/2007 | Little et | D9/543 |
| 7,364,045 | B2 | 4/2008 | Dygert et al. | 215/44 |
| D586,222 | S | 2/2009 | Little et al. | D9/531 |
| D586,223 | S | 2/2009 | Little et al. | D9/531 |
| D588,008 | S | 3/2009 | Flanagan-Kent et al. | D9/531 |
| D591,600 | S | 5/2009 | Dorn et al. | D9/531 |
| 7,578,412 | B2 * | 8/2009 | Clamage | 220/771 |
| 7,913,874 | B2 * | 3/2011 | Gruskin et al. | 220/771 |
| 2003/0010787 | A1 | 1/2003 | Dalton et al. | 220/912 |
| 2007/0014898 | A1 | 1/2007 | Spirk et al. | 426/106 |
| 2007/0187413 | A1 * | 8/2007 | Gruskin et al. | 220/500 |
| 2008/0029475 | A1 * | 2/2008 | Scarola | 215/398 |
| 2008/0032007 | A1 * | 2/2008 | Scarola | 426/106 |
| 2008/0083695 | A1 | 4/2008 | Nievierowski | 215/384 |
| 2008/0087628 | A1 | 4/2008 | Bangi et al. | 215/384 |

FOREIGN PATENT DOCUMENTS

| | | |
|---|---|---|
| JP | 7-21540 | 4/1995 |
| JP | 11-115922 | 4/1999 |

* cited by examiner

PLASTIC CAN PACKAGE

BACKGROUND

The present disclosure is directed to plastic containers, and particularly to containers including a grip feature for ease of handling and suitable for use with and a bonded metal or foil seal and a replaceable snap on cap. The present disclosure features a package that can be substituted for a standard #10 size can commonly used in restaurants and industrial kitchens.

In restaurants and institutions such as hospitals and dormitories, large inventories of food must be kept on hand for use in preparing meals. The food often is preserved as canned goods, most typically in a #10 can. The standard dimensions of a #10 size can are 7 inches high by a diameter of 6 3/16 inches, and contain about 100 oz. The cans are typically stored on their side a standard vertical storage rack that has been developed for use throughout the food services industry to provide a first in—first out handling of the food inventory to ensure freshness. The standard rack is a metal unit comprising a number of inclined tracks disposed in vertical columns with three to four columns across. The tracks of a typical unit are formed by pairs of angle guides attached to the frame. Each track can accommodate at least six #10 size cans, which constitute one case. As the cans are dispensed from a track the remaining cans roll down the inclined track to the front of the rack. Depending on the design of the rack, the canned goods may be loaded on the storage rack from the front or back of the rack.

The wide use of such racks for the storage of preserved foods mandates that newly developed containers for foods to be used in the food services industry be suitable for handling on the same racks. Due to their size, such cans are rather awkward to handle requiring one to use both hands. There is therefore a need for a container having the same general dimensions of a #10 size can that can be more easily handled yet will withstand the rigors of typical treatment in the food services industry.

SUMMARY

A plastic container can have a base and an open top having an outwardly extending flange. The plastic container can have a body with an enclosed generally cylindrical perimeter surrounding a longitudinal axis between the bottom and the top. A metal foil or sheet or other closure can be secured to the outwardly extending flange to seal the open top. An over cap can be positioned over the closure and removably connected to the outwardly extending flange to protect the closure and form a completed package. The bottom, sealed top, and body together define an interior volume that can be sized to that of a #10 size can. The body can include an opposed pair of longitudinally extending inward protrusions forming a graspable handle. The inward protrusions can divide the body into a generally larger front label surface and a back label surface smaller than the front label surface. Each inward protrusion can include a plurality of longitudinal ridges on a forwardly facing surface. A plurality of circumferential ribs can be situated between an upper end of the inward protrusions and the outwardly extending flange.

Features of such a plastic container and package can include a front label surface occupying at least 180° of the body and a back label surface that is suitable for incorporation of a trademark design or logo reflecting the source of the package or contents. Another feature of such a plastic container can be a heel having a cylindrical upper portion connected to the perimeter of the body. An arcuate lower portion of the heel can connect the closed bottom to a lower edge of the cylindrical upper portion. The heel can include a lug defined by a chordal wall parallel to the longitudinal axis joining an essentially horizontal surface to the cylindrical upper portion of the heel. The lug can be located under the back label surface to control label placement on the plastic container.

Another feature of the container is the plurality of circumferential ribs which can include a plurality of outermost surfaces and a set of indentations vertically separating each rib from any adjacent rib. The outermost surfaces can have a diameter that is the same as the cylindrical upper portion of the heel. The set of indentations can have an innermost diameter that is the same as the cylindrical perimeter portion of the body. The plurality of circumferential ribs can provide sufficient rigidity to the top perimeter of the container to ensure the ability of the container top to stay "round" through transportation and dispensing of the package through the standard can racks in a commercial kitchen.

Another feature of the container can be the shape and dimensions of the inward protrusions to provide a grip to allow for ease of use by kitchen staff. The forwardly facing surface of each inward protrusion can lie in part in a plane defined by a radius through the longitudinal axis. The forwardly facing surface of each inward protrusion can be angularly displaced from a plane passing vertically through the center of the back label surface by an angle of between about 30° and 40°. The rearward facing surface of each inward protrusion can be inclined at an angle of between about 70° and 80° from a plane passing vertically through the center of the back label surface and the center of the front label surface. The minimum distance separating the innermost surfaces of the inward protrusions can be between about 40% and 45% of the diameter of the cylindrical perimeter of the body. The maximum distance separating the rearward edges of the inward protrusions can be between 50% and 55% of the diameter of the cylindrical perimeter of the body.

Another feature of the container is size and shape of the outwardly extending flange that facilitates the use of a conventional snap cap can cover to re-seal open containers that are only partially emptied. The outwardly extending flange can be formed in an extrusion blow mold having the venting features disclosed in co-pending application Ser. No. 12/099,835 filed Apr. 9, 2008, which is hereby incorporated by reference in its entirety.

Other features of the present container and the corresponding advantages of those features will become apparent from the following discussion of the preferred embodiments of the present container, exemplifying the best mode of practice, which is illustrated in the accompanying drawings. The components in the figures are not necessarily to scale, emphasis instead being placed upon illustrating the principles of the features. Moreover, in the figures, like referenced numerals designate corresponding parts throughout the different views.

DESCRIPTION OF A PREFERRED EMBODIMENT

Figure 1:
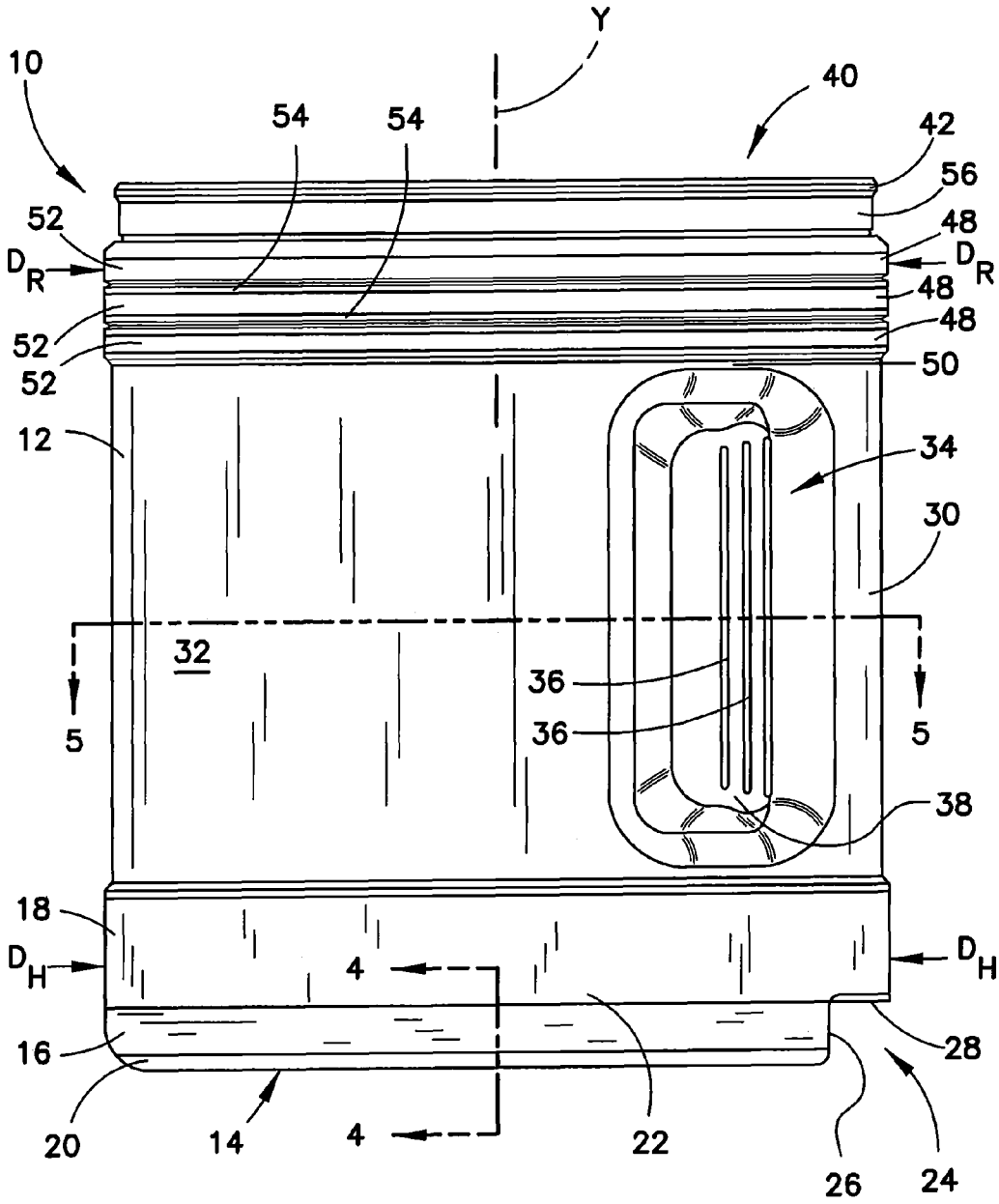
FIG. 1 is a side elevation of a container.
Figure 2:
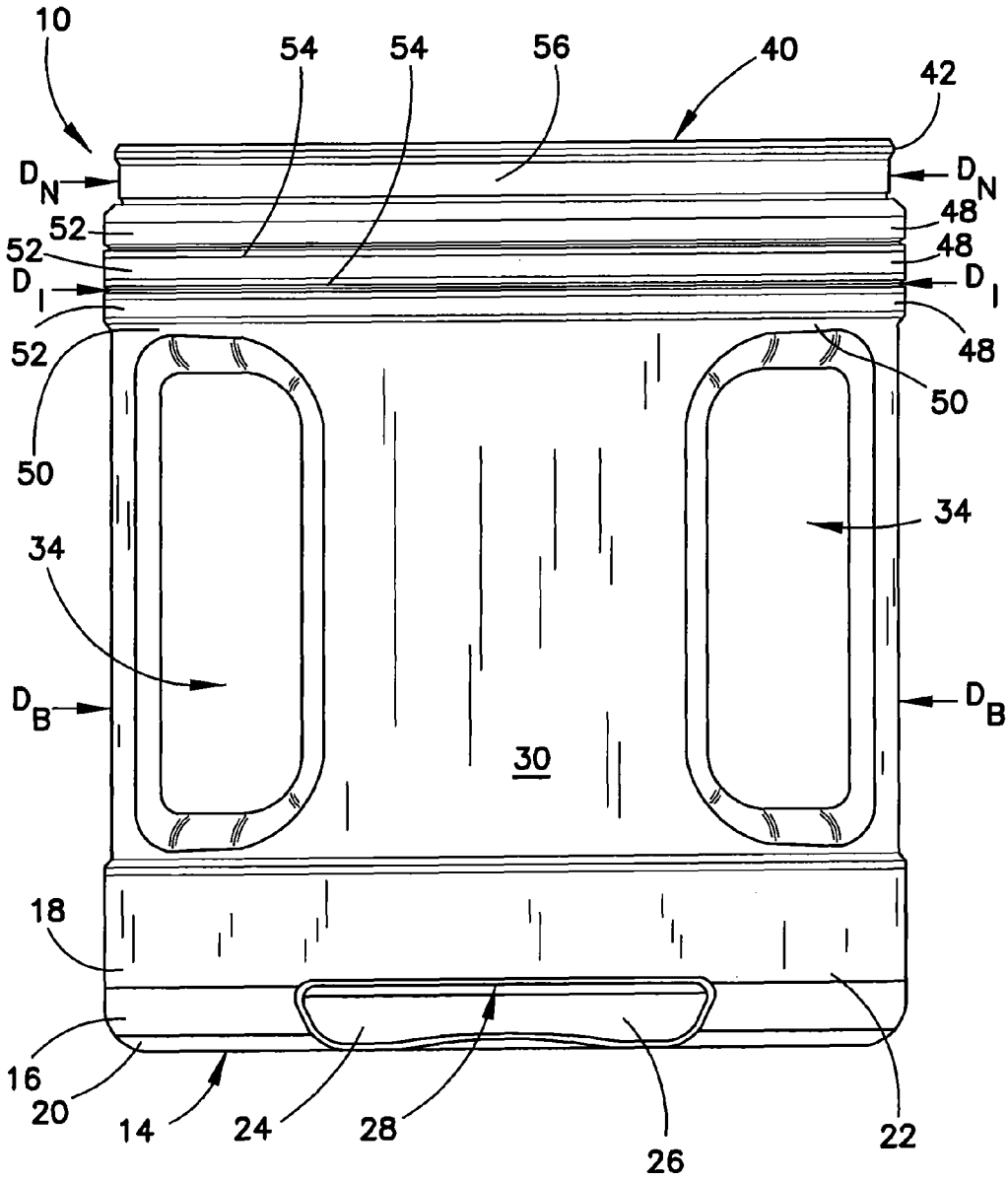
FIG. 2 is a rear elevation of the container as seen from the right side of FIG. 1.
Figure 3:
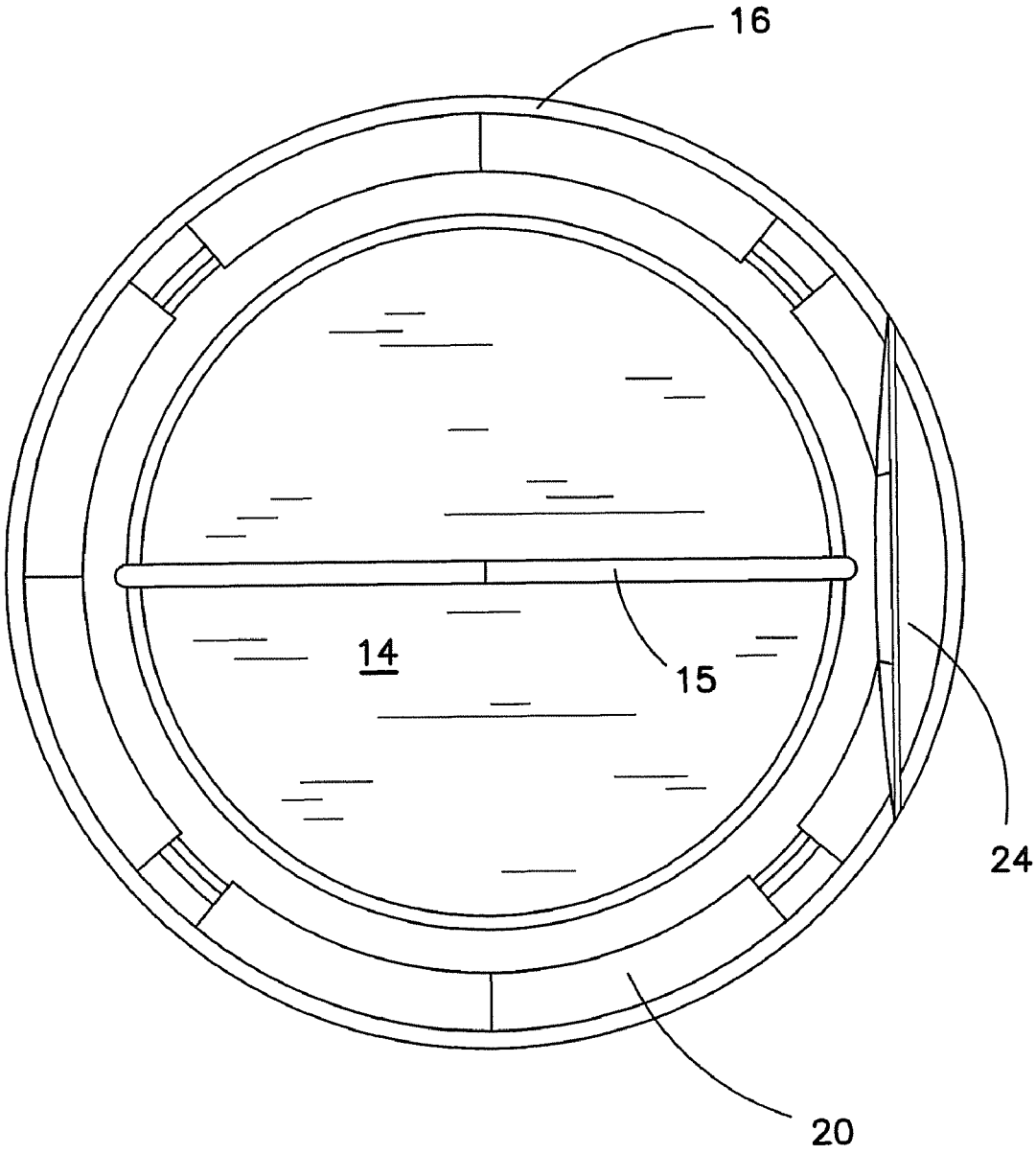
FIG. 3 is a bottom plan view of the container shown in FIG. 1.
Figure 4:
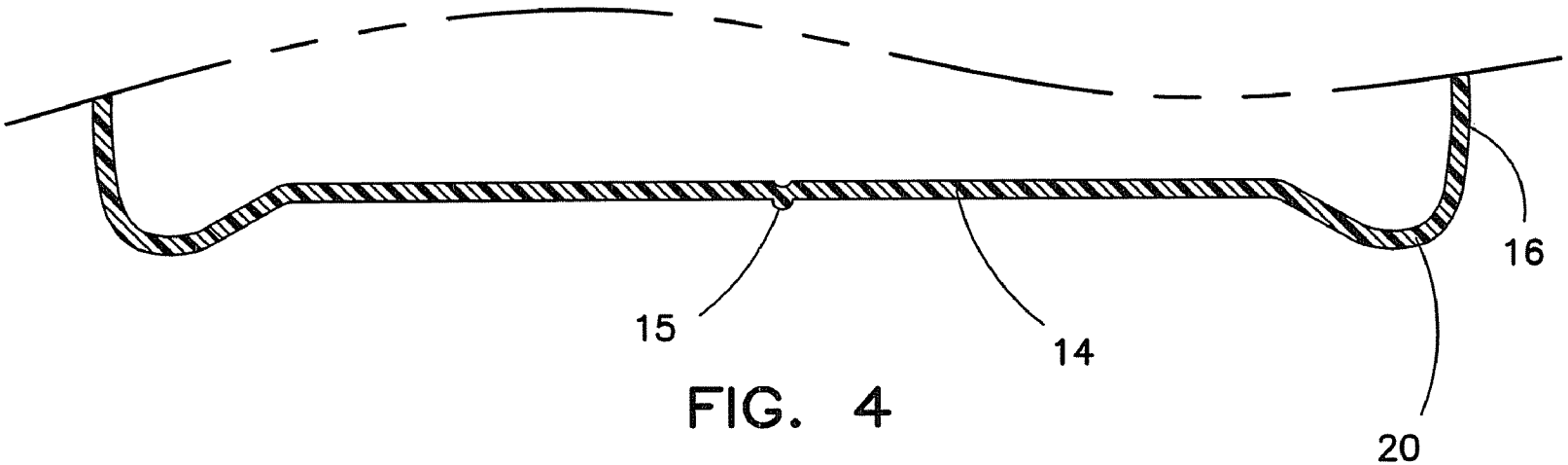
FIG. 4 is a partial sectional view taken along line 4-4 of FIG. 1.
Figure 5:
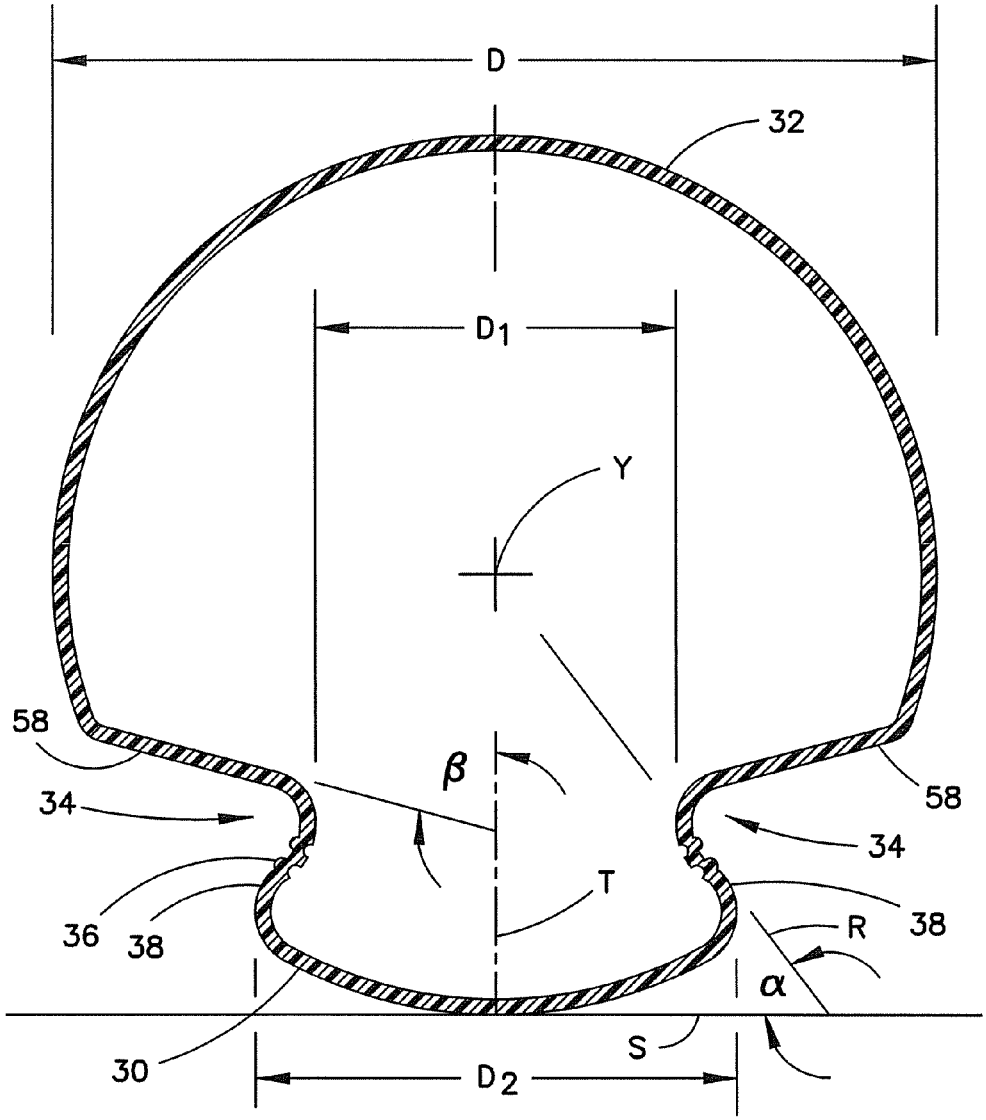
FIG. 5 is a sectional view taken along line 5-5 of FIG. 1.

A container 10 is shown in FIG. 1 and the other Figs that has a generally cylindrical body 12 surrounding a longitudinal axis Y and a closed bottom 14. A heel portion 16 can surround the closed bottom 14. The closed bottom 14 can include a seam 15, as shown in FIGS. 3 and 4, which is the product of the extrusion-blow molding process that can be used to produce such a container 10. The container can be formed by blow-molding an extruded parison having a mass that is desirably not greater than 135 grams. The heel portion 16 can include a cylindrical upper portion 18 connected to the perimeter of the body 12. An arcuate lower portion 20 can connect the closed bottom 14 to a lower edge 22 of the cylindrical upper portion 18. A lug 24 is defined by a chordal wall 26 parallel to the longitudinal axis Y and an adjoining horizontal surface 28. The chordal wall 26 can connect the closed bottom 12 to the adjoining horizontal surface 28. The horizontal surface 28 can join the chordal wall 26 to the cylindrical upper portion 18 of the heel 16 under a back label surface 30. The back label surface 30 is separated from a front label surface 32 by an opposed pair of longitudinally extending inward protrusions 34 forming a graspable handle. As best seen in FIG. 5, the front label surface 32 can occupy at least 180° of the body 12 while the back label surface 30 is generally smaller than the front label surface 32. Each inward protrusion 34 can include a plurality of longitudinal ridges 36 on a forwardly facing surface 38 of the inward protrusion 34. A preferred location for the longitudinal ridges 36 is illustrated in FIG. 5.

Figure 6:
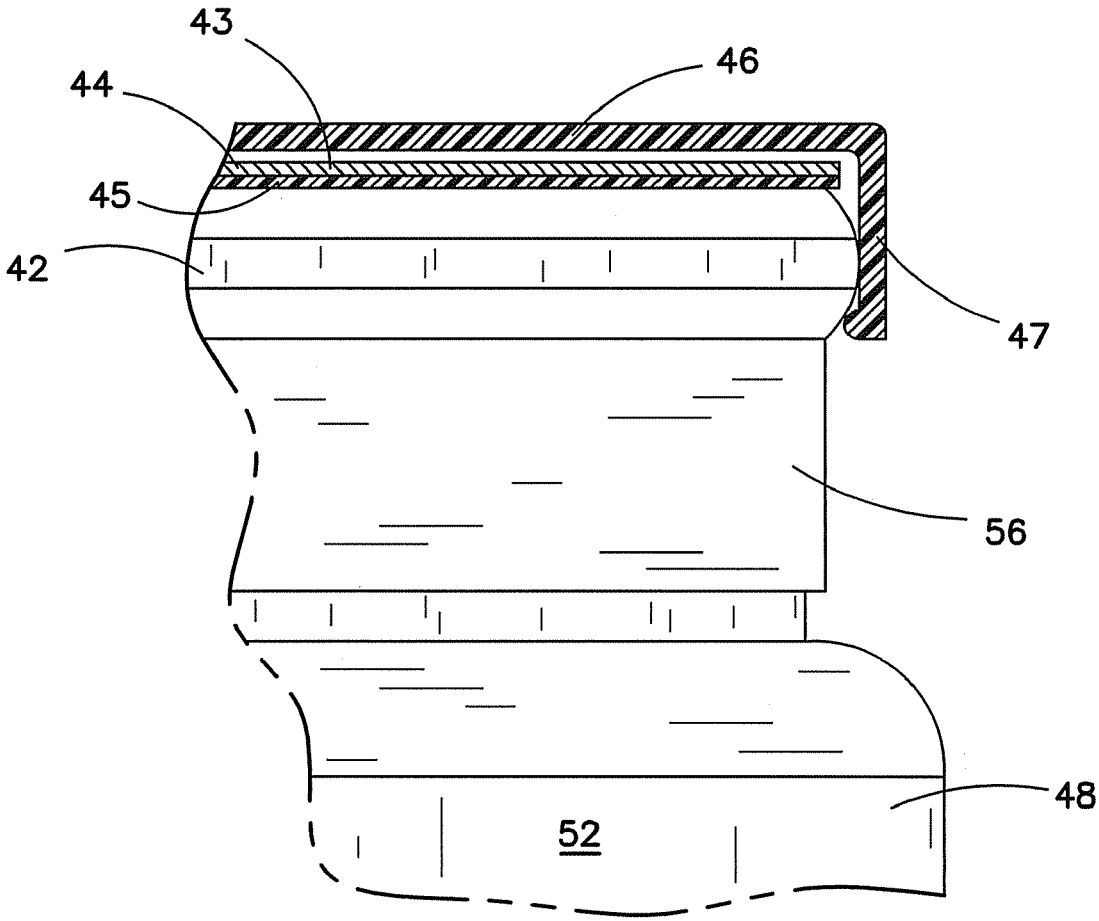
FIG. 6 is a detail view of the outward extending flange of the container shown in FIG. 1 with a sectional view of a foil closure and snap cap.

The container 10 can also include an open top 40 having an outwardly extending flange 42. A foil 44 can be sealed to the outwardly extending flange 42 as shown in FIG. 6 to close the open top 40. The foil 44 can comprise a metal layer 43 and a thermoplastic layer 45. A cap 46 can be positioned over the foil 44 that can be removably connected to the outwardly extending flange 42 by a downwardly extending peripheral edge 47. When the foil is present, the cap 46 acts to protect the foil 44. Once the foil 44 is removed from the container 10, cap 46 can be used to close the open top 40 and inhibit access to the interior volume if the body 12. A plurality of circumferential ribs 48 can be situated between an upper end 50 of the inward protrusions 34 and the outwardly extending flange 42 that can assist the container 10 to retain its cylindrical shape while being stored in a standard food inventory storage rack. The plurality of circumferential ribs 48 can include a plurality of outermost surfaces 52 and a set of indentations 54 vertically separating each rib 48 from any adjacent rib. The outermost surfaces 52 of the ribs 48 can have a diameter $D_R$ that is the same as the diameter $D_H$ of the cylindrical upper portion 18 of the heel 16. The set of indentations 54 can have an innermost diameter $D_I$ that is the same as the diameter $D_B$ of the cylindrical perimeter portion of the body 12. The container 10 can also have a neck portion 56 separating the plurality of circumferential ribs 48 from the outwardly extending flange 40. The neck portion 56 can have a diameter $D_N$ that is less than the innermost diameter $D_I$ of the set of indentations 54.

As best seen in FIG. 5, the forwardly facing surface 38 of each inward protrusion 34 can lie in part in a plane defined by a radius R through the longitudinal axis Y. The forwardly facing surface 38 of each inward protrusion 34 can be angularly displaced from a plane S passing vertically through the back label surface center by an angle $\alpha$ of between 30° and 40°. A rearwardly facing surface 58 of each inward protrusion 34 can be inclined at an angle $\beta$ of between 70° and 80° from a plane T passing vertically through the center of the back label surface 30 and the center of the front label surface 32. To provide a convenient grip for the container 10, the minimum distance $D_1$ separating the innermost surfaces of the inward protrusions 34 can be between 40% and 45% of the diameter D of the cylindrical perimeter of the body 12, while the maximum distance $D_2$ separating rearward edges of the inward protrusions can be between 50% and 55% of the diameter D of the cylindrical perimeter of the body 12.

While these features have been disclosed in connection with the illustrated preferred embodiment, other embodiments of the invention will be apparent to those skilled in the art that come within the spirit of the invention as defined in the following claims.

The invention claimed is:

1. A package comprising a container having a closed bottom, an open top having an outwardly extending flange, and a body having an enclosed generally cylindrical perimeter surrounding a longitudinal axis between the bottom and the top, a foil sealed to the outwardly extending flange to close the open top and a cap positioned over the foil and removably connected to the outwardly extending flange to protect the foil, the bottom, foil sealed top, and body together defining an interior volume; the body including an opposed pair of longitudinally extending inward protrusions forming a graspable handle and dividing the body into a front label surface occupying at least 180° of the body and a back label surface smaller than the front label surface, each inward protrusion including a plurality of longitudinal ridges on a forwardly facing surface, a plurality of circumferential ribs situated between an upper end of the inward protrusions and the outwardly extending flange, a heel having a cylindrical upper portion connected to the perimeter of the body, an arcuate lower portion connecting the closed bottom to a lower edge of the cylindrical upper portion, and a lug defined by a chordal wall parallel to the longitudinal axis coupled to a horizontal surface adjoining the cylindrical upper portion of the heel under the back label surface, wherein the plurality of circumferential ribs includes a plurality of outermost surfaces and a set of indentations vertically separating each rib from any adjacent rib, the outermost surfaces having a diameter that is the same as the cylindrical upper portion of the heel, and wherein the set of indentations have an innermost diameter that is the same as the cylindrical perimeter portion of the body.

2. The package of claim 1, further comprising a neck portion separating the plurality of circumferential ribs from the outwardly extending flange, the neck portion having a diameter less than the innermost diameter of the set of indentations.

* * * * *